United States Patent [19]

Marach

[11] Patent Number: 4,527,849

[45] Date of Patent: Jul. 9, 1985

[54] SNAP-IN MOUNTING DEVICE FOR ELECTRICAL DEVICES

[75] Inventor: David R. Marach, Sleepy Hollow, Ill.

[73] Assignee: Allied Corporation, Morris Township, Morris County, N.J.

[21] Appl. No.: 518,594

[22] Filed: Jul. 29, 1983

[51] Int. Cl.[3] ..... H01R 13/62

[52] U.S. Cl. ..... 339/59 M; 339/91 R; 339/125 R; 339/198 P

[58] Field of Search ..... 339/59 M, 59 R, 75 R, 339/75 M, 91 R, 198 P, 198 R, 125 R, 125 L

[56] References Cited

U.S. PATENT DOCUMENTS

| | | | |
|---|---|---|---|
| 2,762,026 | 9/1956 | Knohl | 339/198 P |
| 3,020,513 | 2/1962 | Quackenbush | 339/91 R |
| 3,535,675 | 10/1970 | Baumanis | 339/125 R |
| 3,686,619 | 8/1972 | McCardell, Jr. et al. | 339/59 M |
| 3,821,691 | 6/1974 | Reimer | 339/75 R |
| 3,842,388 | 10/1974 | Harwood et al. | 339/59 R |
| 4,222,624 | 9/1980 | Eme et al. | 339/75 M |
| 4,449,767 | 5/1984 | Weidler | 339/91 R |

FOREIGN PATENT DOCUMENTS 2019116 10/1979 United Kingdom ..... 339/198 P

*Primary Examiner*—Gil Weidenfeld
*Assistant Examiner*—Gary F. Paumen
*Attorney, Agent, or Firm*—Roger H. Criss

[57] ABSTRACT

Two variations of a simplified structure for retaining a device to a mounting surface are appropriate for use with a disconnect block, or for removably retaining any device to a mounting surface. As a disconnect block, cooperating connector portions in mating surfaces of fixed and removable body portions prevent motion transverse to the mating surfaces. The removable portion is provided with a flexible portion containing projections which mate with apertures in the mounting surface. The flexible portion is pried away from the mounting surface to raise the projections from the holes in the mounting surface and release the removable portion. In a second embodiment, a mounting surface is provided with two facing inverted L-shaped projections, a stop projection, and at least one hole. The device base member includes cooperating projections, and a flexible portion with a projection adapted to engage the hole in the mounting surface.

3 Claims, 5 Drawing Figures

SNAP-IN MOUNTING DEVICE FOR ELECTRICAL DEVICES

The instant invention relates generally to the field of mounting for electrical devices. In particular, the instant application relates to a snap-in mounting for fastening electrical devices, in particular movable sections of disconnect blocks, to a metallic chassis.

BACKGROUND OF THE INVENTION

Many pieces of electrical equipment are provided with an electrical connection device, consisting of two separate pieces, a stationary block and a movable block. The stationary block is permanently affixed to the chassis, and internal wiring of the device or machine is connected to it. The movable block is connected to wiring supplying power at the site of installation, and joined to the fixed terminal block to supply power to the machine or device. Such connectors are often used in such applications as electric stoves and the like. Conventionally, the movable part is joined to the fixed part, and bolted to the chassis or mounting surface or to the stationary part. The bolts used may be removed to allow separation of the movable and stationary parts, for servicing the equipment.

It is, of course, necessary for clearance to be provided between electrically-live terminations and grounded or floating conductive members. Predetermined clearances must be provided between live terminations and the chassis or mounting screws, and a predetermined "creep" distance must be maintained along the surface of the connector device between live terminations and grounded or floating conductive portions.

In addition to the extra material necessary to provide these spacings and creep distances, installation and interconnection is a time consuming and difficult task, since the movable part is often joined to the stationary part in cramped locations, where there is barely sufficient room for the hands and tools of the installer.

The instant invention overcomes these and other deficiencies of the prior art.

SUMMARY OF THE INVENTION

In a disconnect device according to the invention, the movable portion has integral connector projections of thermoplastic material surrounding a plurality of first or male contacts. These mate into corresponding recesses in the stationary block housing the corresponding second or female contacts. Once the movable portion is mated to the stationary portion, it is prevented in moving in two of three orthogonal directions. Additional means may also be provided to remove mechanical side loading from the electrical connections. As the movable part is moved into position, a projection from a flexible member, which may be an integral portion of the movable part, snaps into a hole or recess in the chassis or mounting surface, preventing the movable part from moving in the third of three orthogonal axes.

The movable part may be released by inserting a screwdriver blade or other similar prying tool into an opening provided in the flexible member, and prying or twisting with this tool to bend the flexible member and remove the projections of the flexible member from the hole recess in the chassis or mounting surface, allowing the movable part to be moved away from the stationary part.

Although best suited to providing a simplified movable portion for a disconnect device, the principle of the invention is also usable for other devices where mounting may be a problem, involving forming the chassis or mounting surface to have at least two L-shaped projections therefrom and at least one upstanding portion, adapted to receive the base member or portion of an electrical device, and including an aperture for receiving a projection of the flexible portion, so that the L-shaped projections prevent motion of the base member or portion in first and second orthogonal axes, and the upstanding portion and cooperation between the projection of the flexible member and the hole or recess in the chassis or mounting surface prevents motion in the third of three orthogonal axes.

These and other objectives, features and advantages of the invention will become apparent from the detailed description which follows.

DESCRIPTION OF THE PREFERRED EMBODIMENTS

Figure 1:
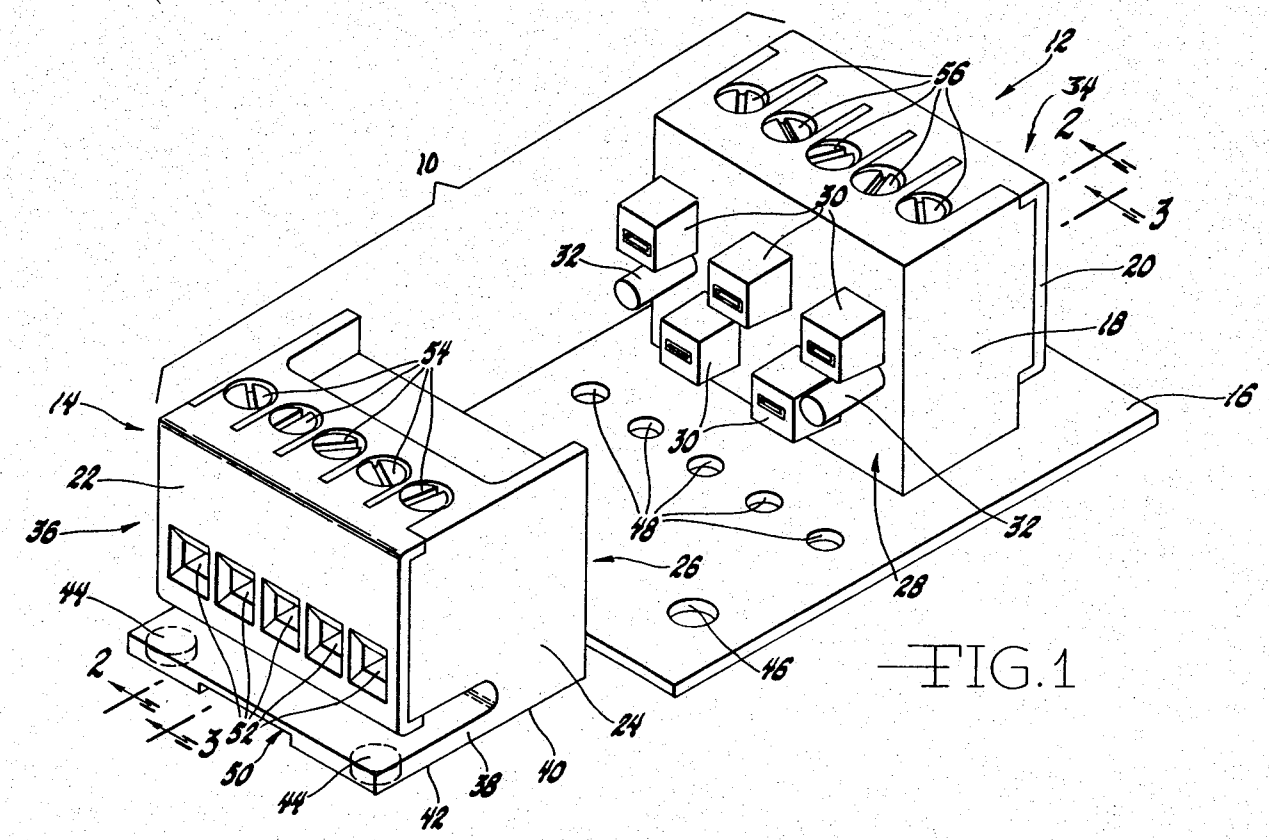
FIG. 1 is a perspective view of a disconnect device in accordance with the preferred embodiment of the invention, the stationary part being shown separated from the movable part.

FIG. 1 shows a disconnect block or device 10, in accordance with the invention. As shown, device 10 includes a first body portion shown as fixed portion 12, and a second body portion shown as movable portion 14, in conjunction with a chassis member or mounting surface 16. As will appear more fully below, fixed portion 12 is rigidly affixed to mounting surface 16, and includes a first part 18 and a second part 20. Similarly, movable portion 14 includes a first part 22 and a second part 24. Second part 24 defines a first face portion 26, better shown in FIGS. 2 and 3, adapted to mechanically and electrically interconnect with fixed portion 12. As shown, first part 18 of fixed portion 12 includes a second face portion 28 adapted to mechanically and electrically interconnect with first face portion 26 and to prevent movement of movable portion 14 in a direction transverse to face portion 26 when face portions 26 and 28 are engaged. As shown, second face portion 28 includes a plurality of connector projections 30, and a plurality of alignment pins 32, which, as will be apparent, are not strictly necessary, but are preferably included, since it may be desirable in some applications to increase the clearance between connector projections 30 and their mating connector recesses, illustrated in FIGS. 2 and 3.

Figure 2:
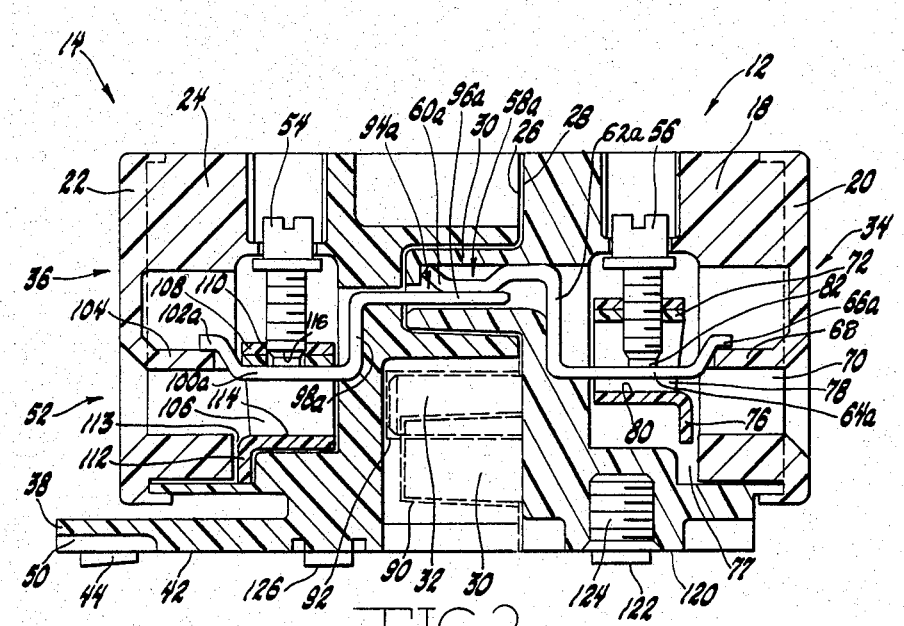
FIG. 2 is a sectional view taken along line 2—2 in FIG. 1.
Figure 3:
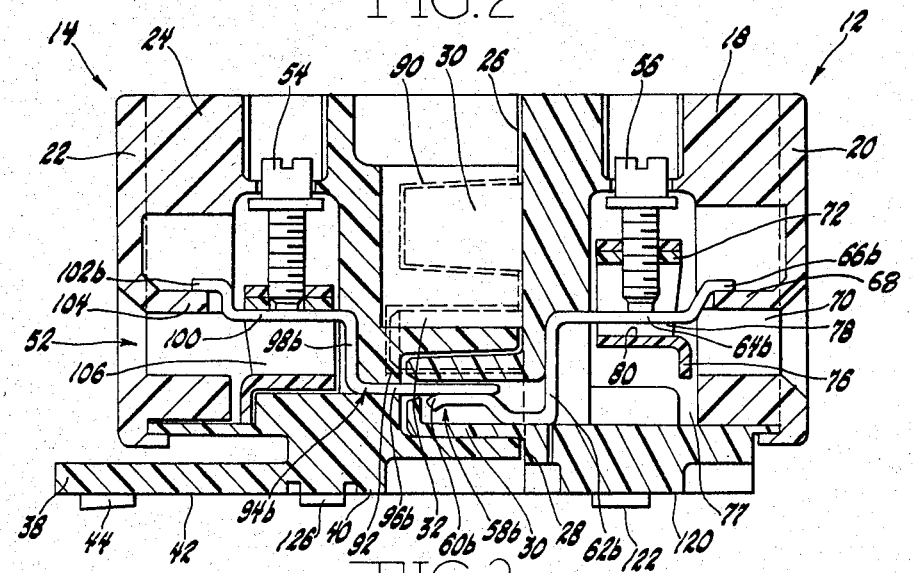
FIG. 3 is a sectional view taken along line 3—3 in FIG. 1.

Fixed portion 12 further defines a third face portion 34, better shown in FIGS. 2 and 3, and preferably identical in structure to fourth face portion 36 of movable portion 14.

Movable portion 14 includes a flexible portion 38 shown as integral with, but also may be contiguous with bottom surface 40 of portion 14. Flexible portion 38 is shown as integral with second part 24, although obviously it may be a separate part attached in any appropriate manner. Bottom surface 42 of flexible portion 38 is provided with at least one protrusion 44 therefrom, adapted to engage a hole or recess such as hole 44 in mounting surface 16 when surfaces 40 and 42 are adjacent mounting surface 16 and face portions 26 and 28 are engaged. As will be apparent, the engagement between faces 28 and 26 prevent relative motion of portions 12 and 14 in two of three orthogonal axes, and the cooperation between protrusions 44 and holes such as 46 presents relative motion in the third of three orthogonal axes.

As illustrated in FIG. 1, additional means for opposing motion in two orthogonal directions may also be provided. In the illustrated embodiment, a plurality of selectively positioned apertures 48 are provided in mounting surface 16, to receive a corresponding plurality of second projections from bottom surface 40, better shown in FIGS. 2 and 3. Apertures 48, and corresponding second projections are not necessary to practice the invention, but are preferably provided. Not only will properly positioned apertures 48 aid in establishing proper clearances between face portions 26 and 28 to prevent the possibility that portions 12 and 14 may wedge together but they also strengthen the interconnection between portions 12 and 14 by absorbing the force of an accidental impact transverse to face portions 26 and 28.

To allow movable portion 14 to be separated from fixed portion 12 after assembly, an indentation 50 is provided in surface 42, to allow the insertion of a prying tool such as a screwdriver between flexible portion 38 and mounting surface 16, to remove protrusions 44 from holes 46 and allow portion 14 to be moved away from fixed portion 12.

Also shown in FIG. 1, apertures 52 adapted to receive the end of a wire, and a plurality of clamping screws 54 to retain wires in apertures 52 and establish electrical connection to such wires, as will become further apparent from FIGS. 2 and 3. Fixed portion 12 contains a plurality of clamping screws 56, for the same purpose.

Turning now to FIGS. 2 and 3, sectional views taken along lines 2—2 and 3—3 in FIG. 1, further details of the preferred embodiment of the invention will become apparent. For instance, each connector projection 30 includes a first connector element such as 58*a* or 58*b* shown in FIG. 2. As best shown in FIG. 1, connector projections 30 are arranged in two offset rows, and connector elements 58*a* and 58*b* are similar, but bent appropriately to align with the desired row of connector projections 30. Each connector element 58*a* or 58*b* includes a contact portion shown as 60*a* in FIG. 2 and 60*b* in FIG. 3, an offsetting portion shown as 62*a* in FIG. 2 and as 62*b* in FIG. 3, a wire clamping portion 64*a* or 64*b*, and a supporting portion 66*a* or 66*b*, which rests on a ledge portion 68 defined by a wall of wire-receiving aperture 70. A conventional clamping loop 72 is disposed about wire-clamping portion 64*a*, 64*b*, and is provided with a threaded aperture engaging a clamping screw 56. Clamping loop 72 may be provided with a guide flange 76 which cooperates with a slot 77 defined by the junction of parts 18 and 20 when wire opening 78, defined between wire-clamping portion 64*a*, 64*b* and surface 80 of clamping loop 72 is at its widest point. When screw 56 is rotated, tip 82 will bear against portion 64*a*, and surface 30 will be drawn towards wire-clamping portion 64*a*, clamping a wire inserted through aperture 70 to first connector element 58*a*, 58*b*.

As will be apparent, each connector projection 30 is received in a connector recess 90 in surface 26, and each alignment pin 32 is received in an alignment pin recess 92. Each connector recess contains a second connector element shown as 94*a* in FIG. 2 and 94*b* in FIG. 3. Connector recesses 90 are, as will be apparent, preferably arranged in two or more rows, as are connector projections 30. Each second connector element 94*a*, 94*b* includes a contact portion 96*a*, 96*b* which engages contact portion 60*a*, 60*b* when portions 12 and 14 are engaged, and offsetting portion 98*a*, 98*b* appropriate for aligning first and second connector elements 60*a*, 60*b* and 94*a*, 94*b*, a wire-clamping portion 100*a*, 100*b*, and a supporting portion 102*a*, 102*b*, supported on ledge portion 104 defined by a wall of wire receiving aperture 106. A conventional clamping loop 108 is disposed around each wire-clamping portion 100*a*, 100*b*, and is provided with a threaded aperture 110 for engaging a clamping screw 54, and a guide flange 112 cooperating with a gap 113 when the wire receiving aperture 106 defined between surface 114 and wire-clamping portion 100*a*, 100*b*. As will be apparent, when screw 54 is rotated, tip 116 will bear against wire-clamping portion 100*a*, 100*b*, drawing surface 114 towards portion 100*a*, 100*b*, to clampingly connect a wire inserted through aperture 52 to second connector element 94*a*, 94*b*.

Bottom surface 120 of fixed portion 12 is, in the preferred embodiment of the invention, provided with two projections 122, engaging apertures, not shown, in mounting surface 16, and an aperture 124 for receiving a screw passed through mounting surface 16 to retain fixed portion 12 to surface 16. Aperture 124 is shown as a threaded aperture for clarity, although preferably an unthreaded aperture for receiving a self-tapping screw is provided. As can be seen, mounting fixed portion 12 in this manner establishes a long creep distance between a screw placed in aperture 124 and a first or second connector element 60 or 94, and allows the use of a single screw, since projections 122 will serve to prevent rotation around the axis of a screw in aperture 124.

Surface 42 of movable portion 14 is also preferably provided with a plurality of projections 126 for cooperating with apertures 48, as described above.

Figure 4:
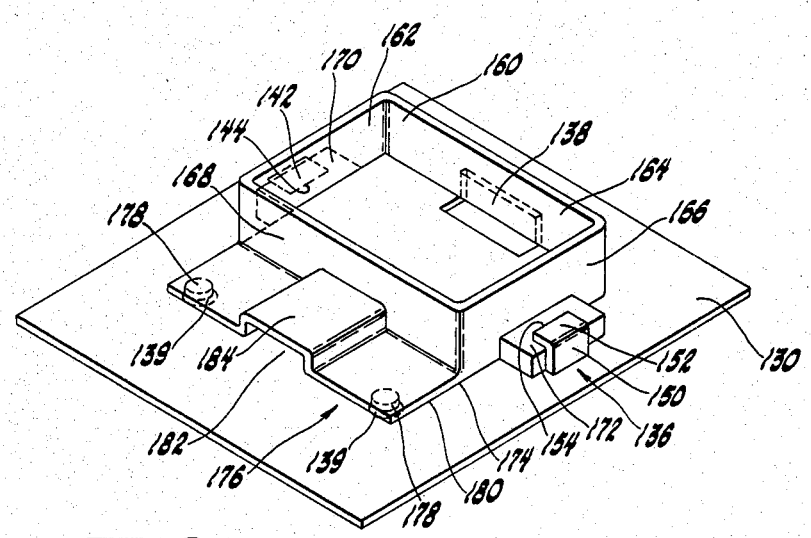
FIG. 4 is an illustration depicting the principle of the invention as applied to a base member suitable for use with a variety of electrical or mechanical devices, in cooperation with a preformed chassis member.

Turning now to FIG. 4, there is shown a mounting arrangement for mounting a mechanical or electrical element to a chassis or mounting surface provided with projections, which cooperate with a removable base element which may be integral with or joined to a wide variety of devices.

Figure 5:
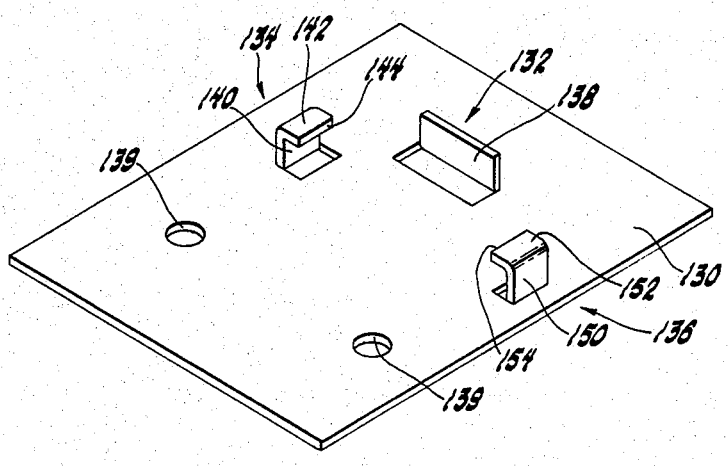
FIG. 5 is a perspective view of the chassis member depicted in FIG. 4.

Turning first to FIG. 5, it can be seen that pre-formed chassis or mounting surface 130 is a generally planar surface with a plurality of projections formed therefrom, preferably by stamping or the like, and defining at least a first protrusion 132, a second protrusion 134 and a third protrusion 136, and at least one hole 138 in surface 130.

First projection 132 is preferably composed of a single portion 138 projecting perpendicular or normal to surface 130. Second portion 134 is preferably an inverted L-shaped protrusion, having a portion 140 normal to surface 130 and a portion 142 integral with portion 140 and normal to portion 140, with its free end 144 oriented perpendicular to the plane of portion 138.

Third projection 136 is similar to second projection 134, being an inverted L-shaped projection having a first portion 150 perpendicular to surface 130 and a second portion 152 integral with portion 150 and parallel to surface 130, with its free end 154 facing towards free end 144 of second projection 134. Portion 138 and hole 139 are on opposite sides of a line defined between free end 154 and free end 144.

Turning now to FIG. 4, a device base member 160 is generally rectangular in shape, and has a first side 162, a second side 164, a third side 166 and a fourth side 168. Side 162 defines a protrusion 170 adapted to be received between portion 142 of inverted L-shaped projection 134 and mounting surface 130. Second side 164 may be substantially flat, and disposed in abutting relationship with portion 138 when device base member 160 is installed position. Third side 166 defines a protrusion 172 adapted to be received between portion 152 of protrusion 136 and mounting surface 130. A flexible portion shown as integral with device base member 160 is shown as integral with bottom surface portion 174 and extending perpendicular to side 168. Flexible portion 176 includes at least one projection 178, for cooperating with a hole 139, and also includes a recess 182, shown as defined by a raised portion 184, adapted to receive a prying tool such as a screwdriver or the like between raised portion 184 and mounting surface 130, to pry flexible portion 176 away from mounting surface 130 and remove protrusions 178 from hole 139 to allow device base member 160 to be removed from mounting surface 130.

As can be seen, projections 134 and 136 prevent device base member 160 from moving in the direction of a first orthogonal or mutually perpendicular axis lying between projections 134 and 136, and portions 142 and 152 of respective projections 134 and 136 prevent motion of member 160 in the direction of a second orthogonal axis, while portion 138 and the cooperation of at least one projection 178 with at least one hole 139 prevent motion of device base member 160 in a third orthogonal axis.

Thus, the instant invention provides a simplified method of removably mounting a device to a mounting surface, which is preferably used in conjunction with a disconnect block, but may be used with a variety of other devices, including such electrical devices as terminal strips, relays, and the like.

In view of the above, it should be noted that numerous modifications and variations of the invention will become apparent to one skilled in the art, and may be easily made, without departing from the spirit and scope of the invention.

I claim:

1. A mounting for an electrical device, comprising:

a generally planar mounting surface;

a first body portion of said electrical device, said first body portion of said electrical device being rigidly affixed to said mounting surface;

a second body portion of said electrical device adapted to mechanically and electrically interconnect with said first portion at a first face portion of said second body portion;

said first body portion having a second face portion, said second face portion being adapted to mechanically and electrically interconnect with said first face portion and to prevent movement of said second body portion transverse to said first face portion when said second face portion is engaged with said first face portion;

said second body portion including a flexible portion extending therefrom distal to said first face portion and adjacent a bottom surface of said second body portion, said bottom surface being a generally planar surface, said bottom surface being disposed adjacent said mounting surface when said first face portion engages said second face portion;

said flexible portion having at least one protrusion from a bottom surface thereof and normal thereto;

said mounting surface having at least one hole therein;

each said protrusion engaging one said hole when said first face portion engages said second face portion and preventing movement of said second body portion normal to said first face portion;

said flexible portion including an indentation in said bottom surface adjacent an edge thereof distal to said first face portion adapted to receive a prying tool for bending said flexible portion away from said mounting surface to disengage said protrusion from said hole.

2. A mounting for an electrical device according to claim 1, wherein:

said electrical device is a disconnect block assembly, said first body portion being a stationary portion of said disconnect block assembly and said second body portion being a removable portion of said disconnect block assembly;

said second face portion of said first body portion including a plurality of connector projections, each said connector projection including one first connector element;

said first body portion having a third face portion, said third face portion including a plurality of first apertures adapted to receive a wire therethrough;

each said first connector element including first wire clamping means disposed adjacent one said first aperture, said first wire clamping means being adapted to clampingly retain said wire in electrical connection with said first connector element;

said first face portion of said second body portion including a plurality of connector recesses, each said connector recess being adapted to receive one said connector projection therein, each said connector recess including one second connector element, each said second connector element including a first terminal portion adapted to mate with a second terminal portion of said first connector element when said connector projections are received in said connector recesses;

said second body portion having a fourth face portion, said fourth face portion including a plurality of second apertures adapted to receive a second wire therethrough;

each said second connector element including second wire clamping means for clampingly retaining said second wire in electrical connection with said second connector element.

3. A mounting device according to claim 2, wherein:

said second face portion includes at least one alignment pin projection projecting therefrom;

said first face portion including at least one alignment recess adapted to closely receive one said alignment pin projection therein when said connector projections are received in said connector recesses.

* * * * *